United States Patent [19]

Rustige

[11] Patent Number: 4,971,534

[45] Date of Patent: Nov. 20, 1990

[54] GEAR PUMP HAVING A PRESSURE BIASED SIDE SEALING PLATE AND THROTTLED OUTLET

[75] Inventor: Hayno Rustige, Ebersbach, Fed. Rep. of Germany

[73] Assignee: Robert Bosch GmbH, Stuttgart, Fed. Rep. of Germany

[21] Appl. No.: 349,622

[22] Filed: May 10, 1989

[30] Foreign Application Priority Data

May 14, 1988 [DE] Fed. Rep. of Germany ..... 3816537

[51] Int. Cl.[5] ..... F04C 2/18; F04C 15/00

[52] U.S. Cl. ..... 418/132

[58] Field of Search ..... 418/132

[56] References Cited

U.S. PATENT DOCUMENTS 2,990,341 7/1963 Oliver ..... 418/132
2,996,999 8/1961 Trautman ..... 418/132
3,476,055 11/1969 Crowther ..... 418/132
4,344,745 8/1982 Herrmann ..... 418/132
4,678,341 7/1987 Stuckey ..... 239/310

FOREIGN PATENT DOCUMENTS 3430271 2/1986 Fed. Rep. of Germany .

*Primary Examiner*—John J. Vrablik
*Assistant Examiner*—David L. Cananaugh
*Attorney, Agent, or Firm*—Michael J. Striker

[57] ABSTRACT

A gear pump comprises two gears arranged in engagement with one another, a sealing plate arranged at one side of the gears and insignificantly movable relative to the latter, two pressure fields including a low pressure field and a high pressure field, and forming a narrowing at the side of the high pressure field such that pressure difference at the narrowing act on the sealing plate so as to lift the sealing plate from side surfaces of the gears starting from a predetermined number of revolutions of the gears which is determined by the narrowing.

6 Claims, 3 Drawing Sheets

GEAR PUMP HAVING A PRESSURE BIASED SIDE SEALING PLATE AND THROTTLED OUTLET

BACKGROUND OF THE INVENTION

The present invention relates to a gear pump. More particularly, it relates to a gear pump which has two interengaging gears, an axially movable sealing plate at one side of the gears and pressed against the side surfaces of the latter, and seals which limit the pressure fields at opposite sides of the gears.

Gear pumps of the above mentioned general type are known in the art. In a known gear pump of this type, the sealing plate is brought in sealing contact with the side surfaces of the gears under the action of stepped hydraulic loading of the pressure fields. Thereby the leakage loss between the high pressure and low pressure sides of the machine is maintained at a low level. However, this construction has the disadvantage in that the feeding quantity increases with the increase in the number of revolutions.

SUMMARY OF THE INVENTION

Accordingly, it is an object of the present invention to provide a gear pump which avoids the disadvantages of the prior art.

In keeping with these objects and with others which will become apparent hereinafter, one feature of the present invention resides, briefly stated, in a gear pump in which at the high pressure side of the pump a narrowing is formed, and a pressure difference which is produced there acts upon the sealing plate so that the number of revolutions determined by the narrowing lifts the sealing plate from the side surfaces of the gears.

When the gear pump is designed in accordance with the present invention, the sealing plate, in addition to the sealing function, also has the function of a flow regulator which after a predetermined feeding volume of the gear pump is operative for desired leakage oil flow from the high pressure side along the lower side of the sealing plate to the low pressure side so that the feeding volume of the pump is limited to a predetermined value. This is achieved without a special flow regulating valve as was known before. Therefore, a significant economy is obtained.

In accordance with another feature of the present invention the narrowing is formed as a throttle or diaphragm in the outlet opening of the gear pump.

Still another feature of the present invention is that a spray apparatus is arranged downstream of the throttle so that the feeding stream flows through the spray apparatus on the one hand, and the spray apparatus forms a connection to a tank.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 2:
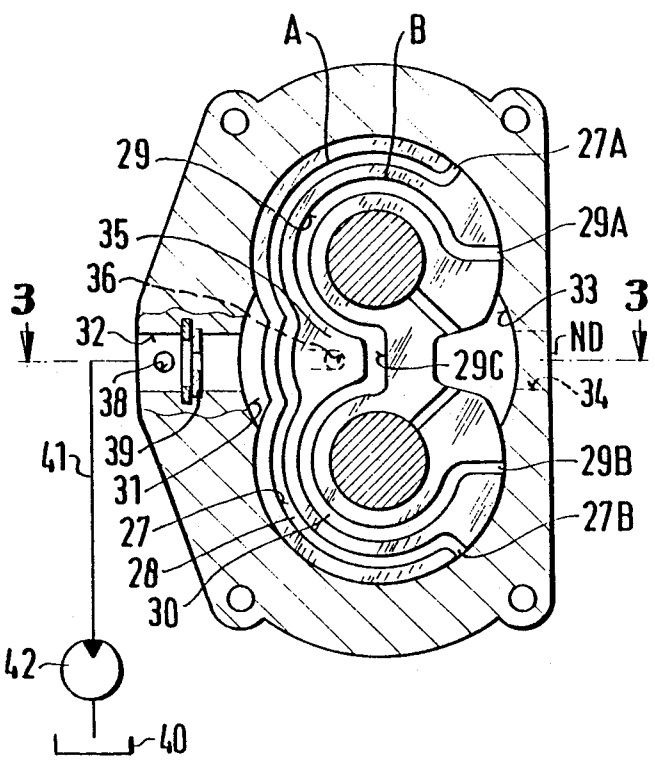
FIG. 2 is a view showing a section of the inventive gear pump taken along the line II—II in FIG. 1.

The gear pump in accordance with the present invention has a housing identified with reference numeral 10 and having an inner chamber 11 in the form of the numeral 8. At both sides the chamber is closed with covers 12 and 13. Two gears 14 and 15 are arranged in outer engagement with one another inside the inner chamber. Their shafts 16 and 17 are supported in spectacle-shaped bearing members 18 and 19. Such bearing members are generally known and therefore not described in detail. A throughgoing passage 20 is provided in the cover 13. An extension 23 of the shaft 17 extends outwardly through the passage 20 and is sealed with a sealing ring 24.

A sealing plate 26 is arranged between the bearing member 18 and the neighboring side surfaces of the gears 14 and 15. It has the contour of the interior of the housing. It covers the whole surface of the gears and has an insignificant axial movement freedom relative to them. Two pressure fields act upon the rear side of the sealing plate, as will be explained hereinbelow.

FIG. 2 shows a view of the bearing member 18, and more particularly its end side which faces toward the sealing plate 26. A first groove train 27 is provided in this end side and extends near the outer contour of the bearing member. The groove train 27 extends partially concentrical to the shafts of the gears from the high pressure side HD toward the low pressure side ND. However, it does not extend up to the latter. The groove train 27 ends respectively in two groove ends **27*a* and 27*b* which extend to the edge of the bearing member. A seal 28** of a rubber elastic material is arranged in the groove train.

A second groove train 29 is formed also concentrically to the shafts of the gears, however, radially inwardly of the groove train 27. The groove train 29 also extends from a high pressure side to a low pressure side, and its ends 29A and 29B extend further toward the low pressure side than the groove ends of the groove train 27. The groove train 29 also has in its central region a recess 29C which leads substantially to a straight line connecting the centers of the shafts. A matching seal 30 is arranged in the groove train 29 and is also composed of a rubber elastic material.

The high pressure side HD is identified by a recess 31. A high pressure opening 32 extends from outside of the housing into the recess at the height of the gears 14 and 15. The low pressure side ND is identified with a recess 33. A low pressure opening 34 extends axis-parallel to the high pressure opening 32 from outside of the housing and opens into the recess 32.

As can be seen from FIG. 2, an intermediate space is provided between the groove trains 27 and 29 and forms a somewhat increased field 35 in the region 29C. The field 35 is loaded through a channel 36 and 37 partially formed in the bearing member 18 and partially in the housing 10. The channel 36 and 37 are in communication with an opening 38 provided in the housing and open into an outlet opening 32. A restriction 39 is arranged in the outlet opening 32. The opening 38 opens in the outlet opening 32 downstream of the restriction 39. The restriction 39 is mounted in the outlet opening 39 by means of a safety ring 39A. It can be recognized that the sealing field B is always loaded with a pressure which acts downstream of the restriction 39.

Figure 1:
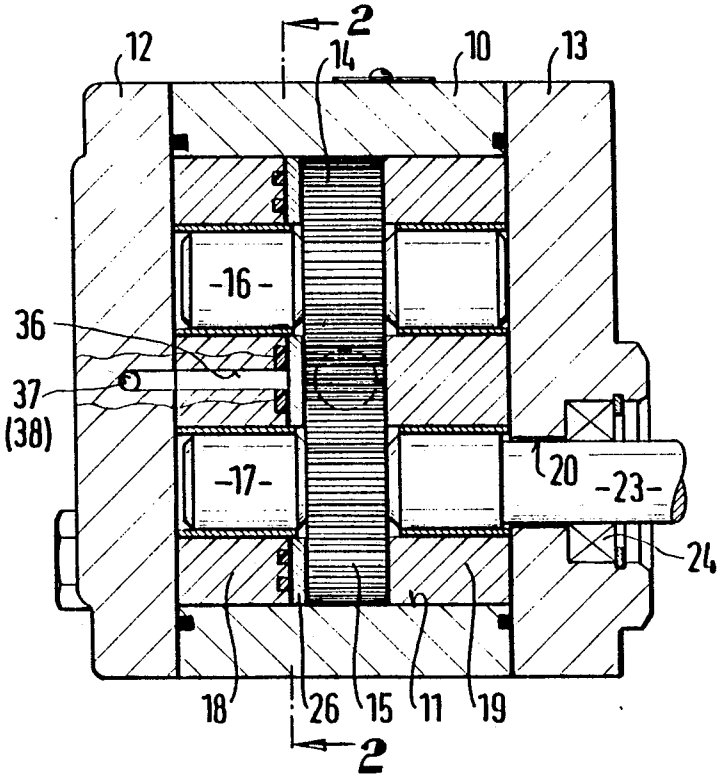
FIG. 1 is a view showing a longitudinal section of a gear pump in accordance with the present invention.
Figure 3:
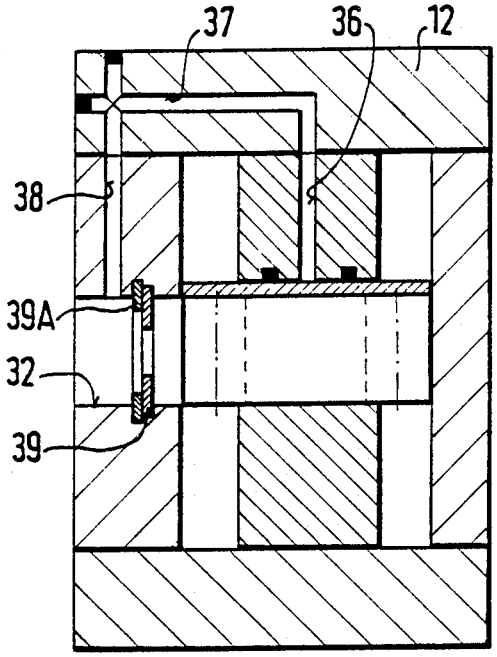
FIG. 3 is a view showing a section taken along the line III—III in FIG. 2.
Figure 4:
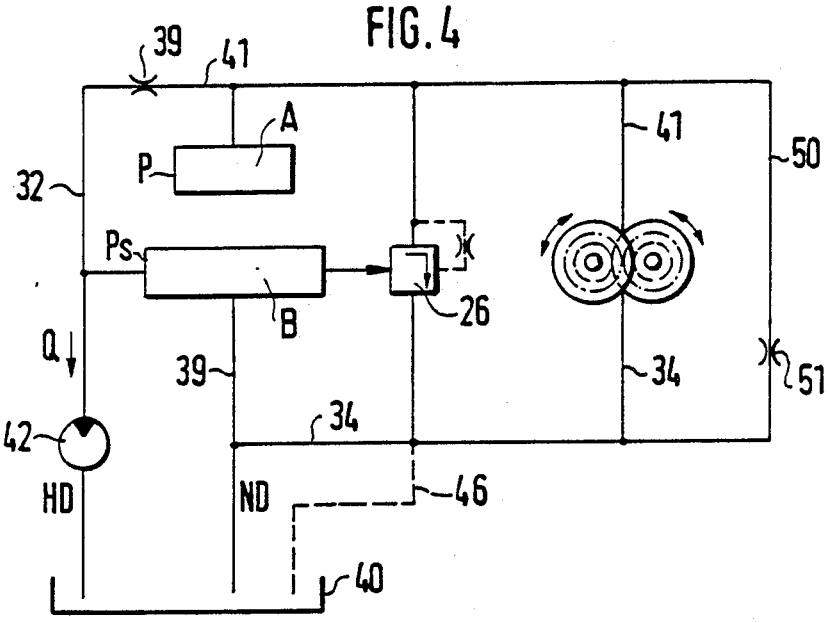
FIG. 4 is a view which schematically shows a hydraulic circuit of the inventive gear pump.

A conduit 41 is connected with the high pressure opening 32 and leads to a consumer 42, and from the consumer to a tank 40. FIG. 4 shows the operation of the pump schematically. The same reference numerals are used for the parts shown in FIGS. 1, 2, 3.

When the gear pump feeds the pressure medium, the pressure medium flows from the tank 40 through the low pressure conduit toward the high pressure opening 32. Through the recess 31 in which the high pressure acts, the pressure medium flows into the pressure field A. This pressure field is always loaded by the feeding pressure. The loading of the pressure field B is performed through the channel 36, 37, 38 from the opening 32 outwardly, which opening is located downstream of the restriction 39. Sealing plate 26 is brought in sealing contact with the side surfaces of the gears. When the feeding quantity of the gear pump increases, the pressure difference at the restriction 39 increases proportionally to the number of revolutions n of the gear pump. When a so-called deregulation point Z (see the diagram of FIG. 4) is reached, the sealing plate 26 is lifted from the side surfaces of the gears since now because of the pressure difference at the restriction 39 no further loading of the pressure field B is produced. Therefore, it can be recognized that the forces from the pressure fields A and B are no longer sufficient for pressing the sealing plate 26 further against the gears. This means that the feeding quantity no longer increases, despite the increasing number of revolutions. This is recognized by the fact that by lifting of the sealing plate 26, a direct connection from the high pressure side to the low pressure side along the side surfaces of the gears take place. Therefore, a feeding quantity regulation is performed without a flow regulating valve which was used in the prior art pumps. Starting from a predetermined number of revolutions, the feed remains constant despite the increasing number of revolutions.

This process is schematically illustrated in FIG. 4. The gear aspirates the pressure medium through the conduit 34 from the tank 40 and displaces it into the conduit 41. The above mentioned pressure drop occurs at the restriction 39. The pressure fields A and B are connected in series. When the deregulating pressure Z is reached, then the sealing plate is lifted, whereby the pressure medium flows from the high pressure side to the low pressure side. The conduit 50 with the throttle 51 symbolically represents the gap losses in the gear pump which always occur, but are very low.

Figure 5:
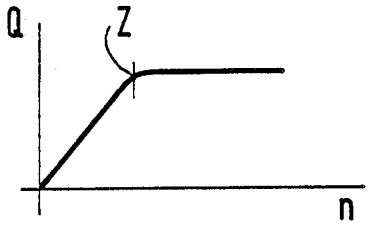
FIG. 5 is a diagram showing a characteristic of the inventive pump.
Figure 6:
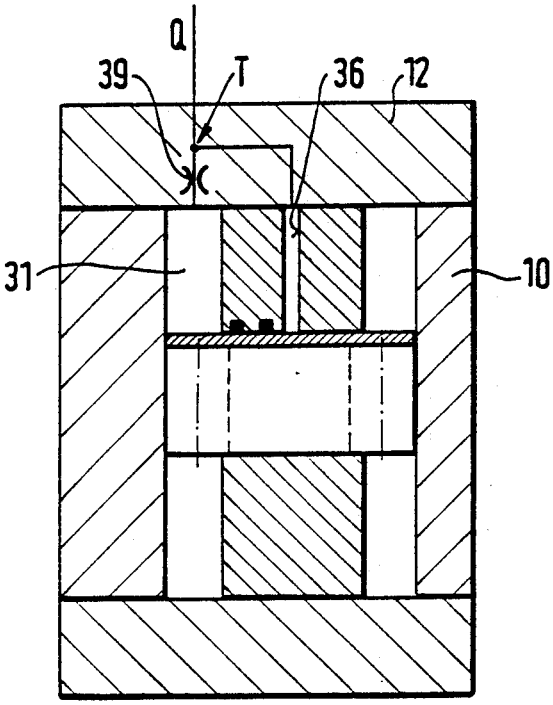
FIG. 6 is a further view schematically showing the gear pump of the present invention.
Figure 7:
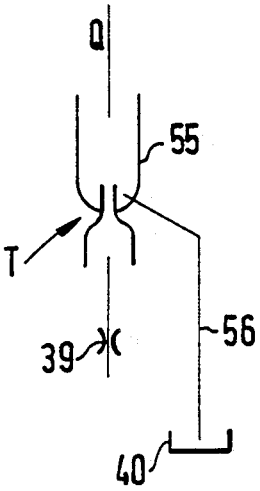

It is also possible to supply the fed pressure medium axially through the recess 31 and an opening in the cover. This variant is schematically shown in FIG. 6. A characteristic line of the pump is shown in FIG. 5, where Q is a delivery rate.

It will be understood that each of the elements described above, or two or more together, may also find a useful application in other types of constructions differing from the types described above.

While the invention has been illustrated and described as embodied in a gear pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A gear pump, comprising two gears arranged in engagement with one another; a sealing plate arranged at one side of said gears and insignificantly movable relative to the latter; means forming two pressure fields including a low pressure field and a high pressure field; means forming an outlet opening; and means forming a narrowing at the side of said high pressure field in said outlet opening such that pressure difference at said narrowing acts on said sealing plate so as to lift said sealing plate from side surfaces of said gears starting from a predetermined number of revolutions of said gears which is determined by said narrowing.

2. A pump as defined in claim 1, wherein said narrowing is formed as a throttle.

3. A pump as defined in claim 1, wherein said narrowing is formed as a restriction.

4. A pump as defined in claim 1; and further comprising a tank; and a spraying apparatus arranged downstream of said throttle so that a liquid flows through said spraying apparatus and said spraying apparatus forms a connection to said tank.

5. A pump as defined in claim 1; and further comprising sealing means arranged at a side of said gears which is opposite to said sealing plate so as to limit said pressure fields.

6. A pump as defined in claim 1; and further comprising shafts arranged to support said gears and having shaft openings, said pressure fields being formed as regions which are at least partially concentric to said shaft openings and being located radially inwardly and radially outwardly of said gears.

* * * * *